US008299146B2

(12) United States Patent
Ohama et al.

(10) Patent No.: US 8,299,146 B2
(45) Date of Patent: Oct. 30, 2012

(54) GOLF BALL

(75) Inventors: Keiji Ohama, Kobe (JP); Hirotaka Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 396 days.

(21) Appl. No.: 12/222,569

(22) Filed: Aug. 12, 2008

(65) Prior Publication Data

US 2009/0062037 A1 Mar. 5, 2009

(30) Foreign Application Priority Data

Aug. 27, 2007 (JP) ..... 2007-219248

(51) Int. Cl.
*A63B 37/00* (2006.01)
*A63B 37/12* (2006.01)
*A63B 37/14* (2006.01)

(52) U.S. Cl. ..... 524/91; 524/100; 524/208; 524/291; 524/336; 524/337; 428/423.3; 473/371; 473/377; 473/378

(58) Field of Classification Search ..... None
See application file for complete search history.

(56) References Cited

U.S. PATENT DOCUMENTS

| | | | | |
|---|---|---|---|---|
| 5,156,405 | A | 10/1992 | Kitaoh et al. | |
| 5,840,788 | A | 11/1998 | Lutz et al. | |
| 6,676,543 | B2 | 1/2004 | Endo et al. | |
| 2002/0077197 | A1 | 6/2002 | Endo | |
| 2002/0086743 | A1 * | 7/2002 | Bulpett et al. | 473/371 |
| 2005/0192122 | A1 | 9/2005 | Isogawa et al. | |

FOREIGN PATENT DOCUMENTS

| | | | |
|---|---|---|---|
| JP | 64-70086 | A | 3/1989 |
| JP | 2000-516521 | A | 12/2000 |
| JP | 2002-126132 | A | 5/2002 |
| JP | 2005-245537 | A | 9/2005 |
| JP | 2005342165 | * | 12/2005 |

OTHER PUBLICATIONS

Madison Polymer Additives UV Absorber Reference Chart; no date.*
Ciba Geigy product brochure for TINUVIN1130; 1991; pp. 1-10.*

* cited by examiner

*Primary Examiner* — David Buttner
(74) *Attorney, Agent, or Firm* — Birch, Stewart, Kolasch & Birch, LLP

(57) ABSTRACT

Golf ball 2 has core 4, cover 6 and paint layer 12. The base polymer of the cover 6 includes a thermoplastic polyurethane elastomer. The cover 6 includes one or more kinds of ultraviolet ray absorbing agents. The paint layer 12 includes one or more kinds of ultraviolet ray absorbing agents. There are one or more kinds of ultraviolet ray absorbing agents (common ultraviolet ray absorbing agent) included in the cover 6 and the paint layer 12. The cover 6 includes the common ultraviolet ray absorbing agent in an amount of A parts by weight per 100 parts by weight of the base polymer, and the paint layer 12 includes the common ultraviolet ray absorbing agent in an amount of B parts by weight per 100 parts by weight of the resin component, with the ratio (A/B) being preferably 0.1 or greater and 10 or less. Preferably, the thermoplastic polyurethane elastomer is an MDI based polyurethane elastomer. The golf ball of the present invention is less likely to subject to color change, and excellent in the scuff resistance performance.

14 Claims, 1 Drawing Sheet

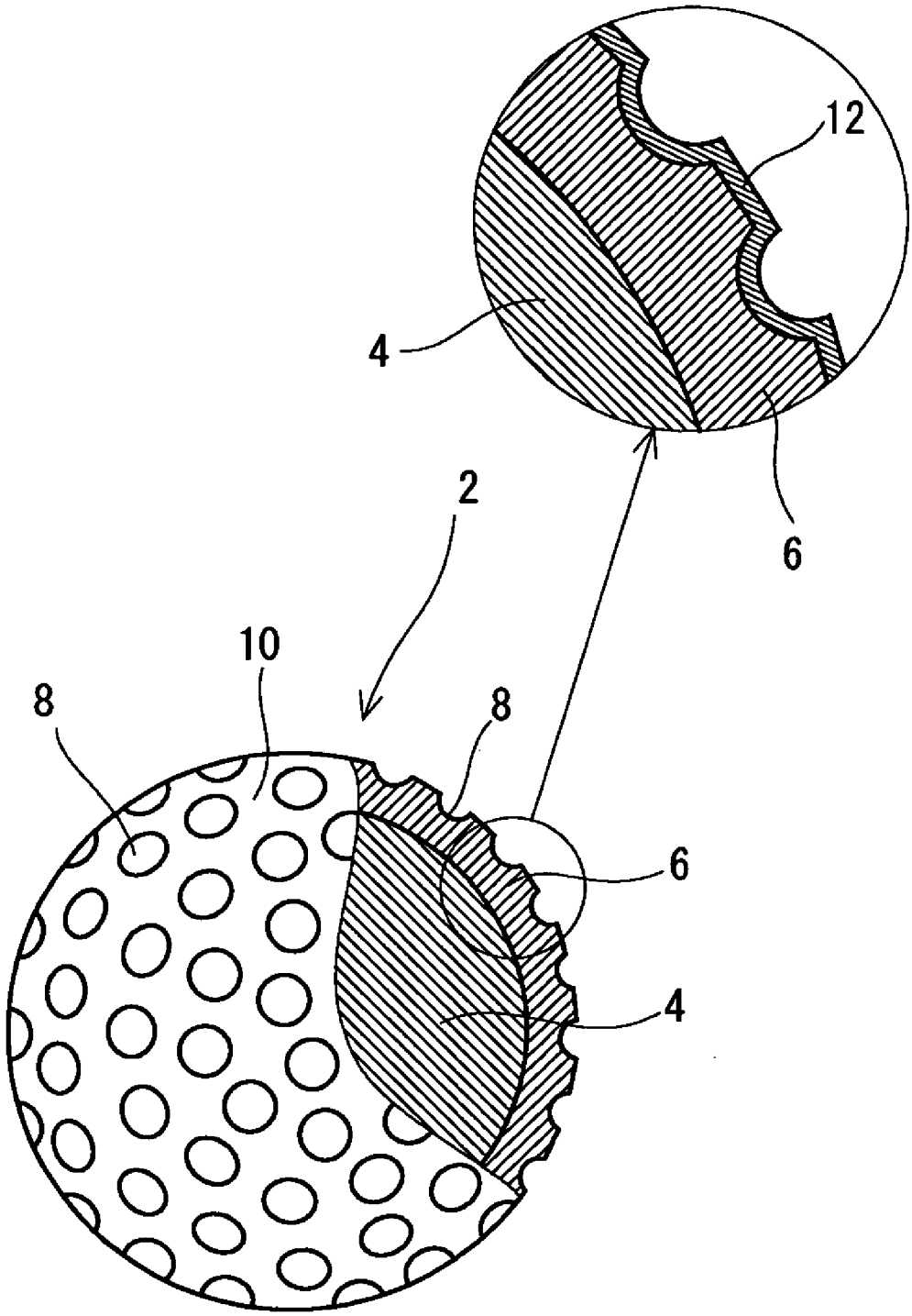
12
4
6
2
10
8
8
6
4

GOLF BALL

This application claims priority on Patent Application No. 2007-219248 filed in JAPAN on Aug. 27, 2007. The entire contents of this Japanese Patent Application are hereby incorporated by reference.

BACKGROUND OF THE INVENTION

1. Field of the Invention

The present invention relates to golf balls in which an urethane based resin is used in the cover.

2. Description of the Related Art

Golf balls in which an urethane resin is used in the cover have been developed. These golf balls are excellent in performances in approach and scuff resistance. These golf balls are likely to be preferred by high-level golf players. Also, the golf balls in which an urethane resin is used in the cover may be employed as balls for golf practice range (generally, may be also referred to as "range ball"). In particular, in the case of use as the ball for golf practice range, durability in repeated use and in use for a long period of time is demanded.

As described above, the golf balls having an urethane cover are excellent in the scuff resistance performance, therefore, scuffing and breakage are less likely to be caused even though they are repeatedly used in golf practice range and the like. To the contrary, the urethane resin is more likely to subject to color change by an ultraviolet ray as compared with ionomer resins. The golf balls having an urethane cover are more likely to subject to color change by use for a long period of time. Particularly, the color change causes problems in the case of the balls for golf practice range.

Techniques in which an ultraviolet ray absorbing agent is included in a cover or a paint was proposed in order to inhibit influences of the ultraviolet ray. Japanese Unexamined Patent Application Publication No. Sho 64-70086 (U.S. Pat. No. 5,156,405) discloses a golf ball in which an ultraviolet ray absorbing agent is included in a cover constituted with an ionomer resin, and in a clear paint. Japanese Unexamined Patent Application Publication No. 2000-516521 (published Japanese translation of a PCT Application) (U.S. Pat. No. 5,840,788) discloses a golf ball in which an urethane top coat includes an optical brightening agent which absorbs ultraviolet rays. Japanese Unexamined Patent Application Publication No. 2002-126132 (United States Patent Application Publication No. 2002/077197) discloses a golf ball in which the surficial part of the ball main body does not substantially include an ultraviolet ray absorbing agent but the paint layer includes an ultraviolet ray absorbing agent.

SUMMARY OF THE INVENTION

There is still potential for inhibition of the color change of the urethane covers. It was proven that the color change of the urethane cover can be effectively inhibited by including an ultraviolet ray absorbing agent in the cover and the paint layer while considering the ratio and the like of the ultraviolet ray absorbing agent, taking into account the synergistic effect of the cover and the paint layer. An object of the present invention is to provide a golf ball which can inhibit the color change of the cover in which an urethane based resin is used.

The golf ball according to the present invention has a core, a cover and a paint layer. The base polymer of the cover includes a thermoplastic polyurethane elastomer. The cover includes one or more kinds of ultraviolet ray absorbing agents. The paint layer includes one or more kinds of ultraviolet ray absorbing agents. There are one or more kinds of common ultraviolet ray absorbing agents included in both the cover and the paint layer. The cover includes the common ultraviolet ray absorbing agent in an amount of A parts by weight per 100 parts by weight of the base polymer, and the paint layer includes the common ultraviolet ray absorbing agent in an amount of B parts by weight per 100 parts by weight of the resin component, with the ratio (A/B) being 0.1 or greater and 10 or less.

Preferably, the thermoplastic polyurethane elastomer is an MDI based polyurethane elastomer.

Preferably, the proportion of the ultraviolet ray absorbing agent included in the cover is 0.01 parts by weight or greater and 10 parts by weight or less per 100 parts by weight of the base polymer. Preferably, the proportion of the ultraviolet ray absorbing agent included in the paint layer is 0.01 parts by weight or greater and 10 parts by weight or less per 100 parts by weight of the resin component.

Preferably, the paint layer includes two or more kinds of ultraviolet ray absorbing agents.

Preferably, the paint layer includes an ultraviolet ray absorbing agent other than the common ultraviolet ray absorbing agent in an amount of C parts by weight per 100 parts by weight of the resin component. Preferably, the ratio (B/C) is 0.2 or greater and 5 or less.

Preferably, the common ultraviolet ray absorbing agent is a benzotriazole based ultraviolet ray absorbing agent.

Preferably, the paint layer includes a triazine based ultraviolet ray absorbing agent as the ultraviolet ray absorbing agent other than the common ultraviolet ray absorbing agent.

BRIEF DESCRIPTION OF THE DRAWINGS

FIG. 1 shows a schematic cross-sectional view illustrating a golf ball according to one embodiment of the present invention.

DESCRIPTION OF THE PREFERRED EMBODIMENTS

Hereinafter, the present invention will be described in detail according to the preferred embodiments with appropriate references to the accompanying drawing.

As shown in FIG. 1, golf ball 2 has spherical core 4, and cover 6 provided so as to cover this core 4. Numerous dimples 8 are formed on the surface of the cover 6. Of the surface of the golf ball 2, a part except for the dimples 8 is land 10. This golf ball 2 has paint layer 12 on the external side of the cover 6. The paint layer 12 abuts on the cover 6. A mark layer is provided on the external side of the cover 6, although this mark layer is not shown in the FIGURE. The paint layer 12 is coated on the external surface of the cover 6. The paint layer 12 covers the entirety of the surface of the cover 6. According to the present invention, the cover is defined as a layer that abuts on the paint layer.

This golf ball 2 has a diameter of from 40 mm to 45 mm. From the standpoint of conformity to a rule defined by United States Golf Association (USGA), the diameter is more preferably equal to or greater than 42.67 mm. In light of suppression of the air resistance, the diameter is more preferably equal to or less than 44 mm, and particularly preferably equal to or less than 42.80 mm. The weight of this golf ball 2 is 40 g or greater and 50 g or less. In light of attainment of great inertia, the weight is more preferably equal to or greater than 44 g, and particularly preferably equal to or greater than 45.00 g. From the standpoint of conformity to a rule defined by USGA, the weight is preferably equal to or less than 45.93 g.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that the polybutadiene is included as a principal component. Specifically, it is preferred that percentage of polybutadiene occupying the entire base rubber is equal to or greater than 50% by weight, and particularly equal to or greater than 80% by weight. Polybutadienes having a percentage of cis-1,4 bonds of equal to or greater than 40%, and further, equal to or greater than 80% are preferred.

The rubber composition for the core 4 includes a co-crosslinking agent. Preferable examples of the co-crosslinking agent in light of the resilience performance include monovalent or bivalent metal salts of an α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate and zinc methacrylate are particularly preferred on the grounds that a high resilience performance can be achieved.

As a co-crosslinking agent, an α,β-unsaturated carboxylic acid having 2 to 8 carbon atoms, and a metal oxide may be also blended. Both components react in the rubber composition to give a salt. This salt is responsible for the crosslinking reaction. Examples of preferable α,β-unsaturated carboxylic acid include acrylic acid and methacrylic acid. Examples of preferable metal oxide include zinc oxide and magnesium oxide.

The amount of the blended co-crosslinking agent is preferably 10 parts by weight or greater and 50 parts by weight or less per 100 parts by weight of the base rubber. By setting amount to be equal to or greater than 10 parts by weight, excellent resilience performance can be achieved. In this respect, the amount is more preferably equal to or greater than 15 parts by weight, and particularly preferably equal to or greater than 20 parts by weight. By setting the amount to be equal to or less than 50 parts by weight, excellent feel at impact can be achieved. In this respect, the amount is more preferably equal to or less than 45 parts by weight, and particularly preferably equal to or less than 35 parts by weight.

Preferably, the rubber composition for use in the core 4 includes organic peroxide together with the co-crosslinking agent. The organic peroxide serves as a crosslinking initiator. The organic peroxide is responsible for the resilience performance. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the blended organic peroxide is preferably 0.1 parts by weight or greater and 3.0 parts by weight or less per 100 parts by weight of the base rubber. By setting the amount to be equal to or greater than 0.1 parts by weight, excellent resilience performance can be achieved. In this respect, the amount is more preferably equal to or greater than 0.3 parts by weight, and particularly preferably equal to or greater than 0.5 parts by weight. By setting the amount to be equal to or less than 3.0 parts by weight, excellent feel at impact can be achieved. In this respect, the amount is more preferably equal to or less than 2.8 parts by weight, and particularly preferably equal to or less than 2.5 parts by weight.

In the core 4 may be blended a filler for the purpose of adjusting the specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the blended filler is determined ad libitum so that the intended specific gravity of the core 4 can be accomplished. Particularly preferable filler is zinc oxide. Zinc oxide serves not only to merely adjust the specific gravity but also as a crosslinking activator. Various kinds of additives such as sulfur, an anti-aging agent, a coloring agent, a plasticizer, a dispersant and the like may be blended in an adequate amount in the core 4 as needed. In the core 4 may be also blended crosslinked rubber powder or synthetic resin powder.

The amount of compressive deformation Ch of the core 4 is preferably equal to or less than 4.0 mm, more preferably equal to or less than 3.8 mm, and particularly preferably equal to or less than 3.5 mm. Upon hitting of the golf ball 2 with a driver, the core 4 is greatly deformed along with the cover 6. This core 4 having a small amount of compressive deformation Ch is responsible for the flight performance upon shots with a driver. When the amount of compressive deformation is too small, feel at impact may be deteriorated. In light of the feel at impact, the amount of compressive deformation Ch is more preferably equal to or greater than 2.8 mm, and particularly preferably equal to or greater than 3.0 mm.

In light of achievement of excellent resilience characteristics, the difference (Ch−Bh) between the amount of compressive deformation Ch of the core 4 and the amount of compressive deformation Bh of the ball 2 is preferably equal to or greater than 0 mm, and more preferably equal to or greater than 0.1 mm. In light of prevention of the cover from being excessively hardened, and improvement of the durability, the difference (Ch−Bh) is preferably equal to or less than 0.4 mm, and more preferably equal to or less than 0.3 mm. In light of achievement of excellent feel at impact, the amount of compressive deformation Bh of the ball 2 is preferably equal to or greater than 2.4 mm, more preferably equal to or greater than 2.6 mm, and still more preferably equal to or greater than 2.8 mm. In light of achievement of excellent resilience characteristics, the amount of compressive deformation Bh is preferably equal to or less than 4.0 mm, more preferably equal to or less than 3.5 mm, and still more preferably equal to or less than 3.4 mm.

Upon measurement of the amount of compressive deformation (amount of compressive deformation Bh or amount of compressive deformation Ch), the spherical body (core 4 or ball 2) is first placed on a hard plate made of metal. Next, a cylinder made of metal gradually descends toward the spherical body. The spherical body intervened between the bottom face of the cylinder and the hard plate is deformed. A migration distance of the cylinder, starting from the state in which an initial load of 98 N is applied to the spherical body up to the state in which a final load of 1274 N is applied thereto is the amount of compressive deformation.

In light of achievement of excellent resilience characteristics, the core 4 has a diameter of preferably equal to or greater than 36 mm, more preferably equal to or greater than 38 mm, and still more preferably equal to or greater than 38.6 mm. In light of achievement of excellent durability by a great thickness of the cover, the core 4 has a diameter of preferably equal to or less than 41.5 mm, more preferably equal to or less than 40.8 mm, and still more preferably equal to or less than 40.6 mm. The core 4 has a weight of preferably 25 g or greater and 42 g or less. The crosslinking temperature of the core 4 is usually 140° C. or higher and 180° C. or lower. The crosslinking time period of the core 4 is usually 10 minutes or longer and 60 minutes or shorter. The core 4 may be composed of two or more layers.

Although not shown in the FIGURE, one or more mid layers may be provided between the core 4 and the cover 6. For the mid layer, a thermoplastic resin composition may be suitably used. Examples of the base polymer of this resin composition include ionomer resins, thermoplastic polyester elastomers, thermoplastic polyamide elastomers, thermoplastic polyurethane elastomers, thermoplastic polyolefin elastomers and thermoplastic polystyrene elastomers. In light of the durability, a thermoplastic elastomer is preferred. Two or more kinds of the resins may be used in combination in the mid layer.

In the resin composition of the mid layer may be blended a filler for the purpose of adjusting the specific gravity and the like. Illustrative examples of suitable filler include zinc oxide, barium sulfate, calcium carbonate and magnesium carbonate. Powder of a highly dense metal may be also blended as the filler. Specific examples of the highly dense metal include tungsten and molybdenum. The amount of the blended filler is determined ad libitum so that intended specific gravity of the mid layer can be accomplished. In the mid layer may be also blended a coloring agent, crosslinked rubber powder or synthetic resin powder.

When the mid layer is provided, this mid layer has a thickness Tm of preferably 0.3 mm or greater and 2.5 mm or less. When the thickness Tm is below the above range, the flight performance upon shots with a driver may be unsatisfactory. In this respect, the thickness Tm is more preferably equal to or greater than 0.5 mm, and particularly preferably equal to or greater than 0.7 mm. When the thickness Tm exceeds the above range, favorable feeling is less likely to be experienced upon hitting of the golf ball 2. In this respect, the thickness Tm is more preferably equal to or less than 2.0 mm.

The cover 6 is constituted with a thermoplastic resin composition. The base polymer of this resin composition includes a thermoplastic polyurethane elastomer. The thermoplastic polyurethane elastomers are soft. Great spin rate is attained upon hitting with a short iron of the golf ball having the cover including this elastomer. The cover including this elastomer is responsible for the control performance upon shots with a short iron. This elastomer is also responsible for the scuff resistance performance of the cover. In addition, this elastomer can serve in achieving excellent feel at impact upon hitting with a putter or a short iron.

The thermoplastic polyurethane elastomer includes a polyurethane component as a hard segment, and a polyester component or a polyether component as a soft segment. Illustrative examples of isocyanate as a raw material of the polyurethane component include alicyclic diisocyanate, aromatic diisocyanate and aliphatic diisocyanate. Two or more kinds of the diisocyanate may be used in combination.

Illustrative examples of the alicyclic diisocyanate include 4,4'-dicyclohexylmethane diisocyanate ($H_{12}$MDI), 1,3-bis (isocyanatomethyl)cyclohexane ($H_6$XDI), isophorone diisocyanate (IPDI) and trans-1,4-cyclohexane diisocyanate (CHDI).

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

In the present invention, an MDI based thermoplastic polyurethane elastomer is preferred. The MDI based thermoplastic polyurethane elastomer referred to herein is defined as a thermoplastic polyurethane elastomer a part or all of the isocyanate of which, as the raw material of the polyurethane component, is 4,4'-diphenylmethane diisocyanate (MDI). This MDI based thermoplastic polyurethane elastomer is highly versatile, and inexpensive.

Since 4,4'-diphenylmethane diisocyanate (MDI) has two benzene rings, double bonds are included in the skeleton. Thus, the MDI based thermoplastic polyurethane elastomer is more likely to subject to color change by the influences of the ultraviolet ray. The MDI based thermoplastic polyurethane elastomer is likely to generate quinone imide, an azo compound or the like that is a coloring substance by an ultraviolet ray. The generation of the quinone imide and azo compound accounts for the color change. This color change is also referred to as yellowing. When the MDI based thermoplastic polyurethane elastomer is used, the color change is significantly problematic. According to the present invention, the color change, a disadvantage of the MDI based thermoplastic polyurethane elastomer, can be effectively inhibited.

Specific examples of the thermoplastic polyurethane elastomer include trade names "Elastolan 1195ATR", "Elastolan 1190ATR", "Elastolan ET890", "Elastolan XNY90A", "Elastolan XNY97A", "Elastolan XNY85A" and "Elastolan ET880", available from BASF Japan Ltd; and trade name "Rezamin P4585LS" and trade name "Rezamin PS62490" available from Dainichiseika Color & Chemicals Mfg. Co., Ltd. In light of the possibility that an appropriate hardness of the cover can be attained, "Elastolan 1195ATR", "Elastolan 1190ATR", "Elastolan XNY97A" and "Elastolan XNY90A" are preferred.

Among these, illustrative examples of the MDI based thermoplastic polyurethane elastomer include specifically, "Elastolan 1195ATR", "Elastolan 1190ATR" and "Elastolan ET890". In light of the possibility that an appropriate hardness can be attained, "Elastolan 1195ATR" is particularly preferred.

Other resin may be also used in combination with the thermoplastic polyurethane elastomer. Examples of the resin which can be used in combination include thermoplastic polyester elastomers, thermoplastic polyamide elastomers, thermoplastic polyolefin elastomers, styrene block-containing thermoplastic elastomers and ionomer resins. When the thermoplastic polyurethane elastomer and the other resin are used in combination, the thermoplastic polyurethane elastomer is preferably included as a principal component of the base polymer in light of the spin performance and scuff resistance performance. The percentage of the thermoplastic polyurethane elastomer occupying in total base polymer is preferably equal to or greater than 50% by weight, more preferably equal to or greater than 70% by weight, and particularly preferably equal to or greater than 85% by weight.

In addition to the ultraviolet ray absorbing agent described later, the cover 6 may also include an agent for adjusting the specific gravity such as barium sulfate, a dispersant, an anti-aging agent, a light stabilizer, a fluorescent brightening agent and the like.

In light of achievement of excellent resilience characteristics, the cover 6 has a material hardness (Shore D) of preferably equal to or greater than 40, and more preferably equal to or greater than 42. When the material hardness of the cover 6 is excessively great, the breakage is likely to be caused. In light of the durability, the cover 6 has a material hardness of preferably equal to or less than 55, more preferably equal to or less than 52, and further preferably equal to or less than 50.

The material hardness of the cover 6 may be measured in accordance with a standard of "ASTM-D 2240-68". For the measurement, an automated rubber hardness scale (trade name "P1", available from Koubunshi Keiki Co., Ltd.) which is equipped with a Shore D type hardness scale is used. For the measurement, a sheet formed by hot pressing to have a thickness of about 2 mm is used. Prior to the measurement, the sheet is stored at a temperature of 23° C. for two weeks. When the measurement is carried out, three sheets are overlaid. A sheet consisting of the thermoplastic polyurethane elastomer alone may be used for the measurement.

The thickness Tc of the cover 6 is not limited. In light of the resilience performance, the thickness Tc is preferably equal to or less than 2.5 mm, more preferably equal to or less than 2.2 mm, and still more preferably equal to or less than 1.8 mm. In light of the durability, the thickness Tc is preferably equal to or greater than 1.0 mm, and more preferably equal to or greater than 1.3 mm.

One, or two or more paint layers are provided. In light of the productivity, it is preferred to provide one paint layer. However, in light of inhibition of the ultraviolet ray that reaches to the cover, it is preferred to provide two or more paint layers that include the ultraviolet ray absorbing agent. When two layers that include the ultraviolet ray absorbing agent are provided, the types and/or combination of the ultraviolet ray absorbing agents are preferably different between these two layers.

In light of inhibition of the ultraviolet ray that reaches to the cover 6, the paint layer 12 has a thickness of preferably equal to or greater than 2 μm, more preferably equal to or greater than 3 μm, and still more preferably equal to or greater than 5 μm. When the paint layer 12 is too thick, paint pool or the like is likely to be yielded, whereby ununiform appearance, and deterioration of the appearance and color tone are often found. In light of achievement of favorable appearance, the paint layer 12 has a thickness of preferably equal to or less than 30 μm, more preferably equal to or less than 20 μm, and still more preferably equal to or less than 15 μm.

The paint layer 12 may be either a clear paint layer or an enamel paint layer, but a clear paint layer is preferred. The resin component in the paint layer 12 is not limited. Examples of the resin component include acrylic resins, epoxy resins, polyurethane resins, polyester resins, cellulose based resins and the like. As the paint layer, a two-component cured polyurethane resin described later is preferred. The two-component cured polyurethane resin can yield a paint layer that is even more excellent in the durability.

The two-component cured polyurethane resin is a polyurethane resin obtained by allowing a base material to react with a curing agent. Exemplary two-component cured polyurethane resin may be, e.g., a resin prepared by curing a base material containing a polyol component with a polyisocyanate compound, and a derivative thereof.

The base material containing a polyol component preferably includes the urethane polyol described below. The urethane polyol is synthesized by a reaction of polyisocyanate with polyol. The polyisocyanate used in the synthesis is not particularly limited as long as it has two or more isocyanate groups. The polyisocyanate may be, for example, one, or a mixture of two or more of: aromatic diisocyanate such as 2,4-toluene diisocyanate, 2,6-toluene diisocyanate, mixtures of 2,4-tolylene diisocyanate and 2,6-tolylene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic diisocyanate or aliphatic diisocyanate such as 4,4'-dicyclohexylmethane diisocyanate ($H_{12}$MDI), hydrogenated xylylene diisocyanate ($H_6$XDI), hexamethylene diisocyanate (HDI), isophorone diisocyanate (IPDI), and norbornene diisocyanate (NBDI). Among these, non-yellowing polyisocyanate is preferred in light of the weather resistance. Examples of the non-yellowing polyisocyanate include TMXDI, XDI, HDI, $H_6$XDI, IPDI, $H_{12}$MDI, NBDI and the like. Meanwhile, the polyisocyanate can be used also as a curing agent for allowing the urethane polyol to be hardened.

The polyol used in producing the urethane polyol is not particularly limited as long as it has multiple hydroxyl groups, and for example, polyols having a low molecular weight, polyols having a high molecular weight and the like may be exemplified. Examples of the polyol having a low molecular weight include e.g., diols such as ethylene glycol, diethylene glycol, triethylene glycol, 1,3-butanediol, 1,4-butanediol, neopentyl glycol and 1,6-hexanediol; triols such as glycerin, trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-ε-caprolactone (PCL); polycarbonate polyols such as polyhexamethylene carbonate; acrylic polyols, and the like. Among the polyols as described above, polyols having a weight average molecular weight of 50 to 2,000, still further, approximately 100 to 1,000 are preferred. These polyols may be used singly, or two kinds or more may be also used as a mixture.

The urethane polyol is a polyol having urethane bonds formed by a reaction of the polyisocyanate with the polyol, and also having a hydroxyl group. Typically, the hydroxyl group is positioned at the end of the urethane polyol. The proportion of the urethane bonds in the urethane polyol is preferably 0.1 mmol or greater and 5 mmol or less per gram of the urethane polyol. The proportion of the urethane bonds correlates with the rigidity of the formed paint layer. When this proportion is equal to or greater than 0.1 mmol, the urethane bonds in the paint layer are increased, whereby the scuff resistance performance can be improved. When this proportion is equal to or less than 5 mmol, the paint layer is more likely to follow deformation of the golf ball main body, whereby generation of crack can be inhibited.

In light of shortening of the drying time period, and improvement of workability and productivity, the urethane polyol has a weight average molecular weight of preferably equal to or greater than 4,000, and more preferably equal to or greater than 4,500. In light of increase in the hydroxyl value of the urethane polyol to increase the amount of the reaction after coating, thereby improving the adhesiveness with the substrate, the urethane polyol has a weight average molecular weight of preferably less than 10,000, and more preferably equal to or less than 9,000. Additionally, when this weight average molecular weight is equal to or less than 9,000, a compact paint layer can be formed which is accompanied by less lowering of the adhesiveness even in a wetting condition.

In light of increase in the amount of the reaction with the curing agent, and improvement of adhesion strength with the substrate, the hydroxyl value of the urethane polyol is preferably equal to or greater than 15 mg KOH/g, and more preferably equal to or greater than 25 mg KOH/g. In light of inhibition of the breakage in hitting, and in an attempt to improve the productivity by shortening the reaction time with the curing agent as well as shortening the drying time period, the urethane polyol has a hydroxyl value of equal to or less than 130 mg KOH/g, and more preferably equal to or less than 120 mg KOH/g.

The foregoing urethane polyol may be obtained by allowing polyol as the raw material to react with polyisocyanate at a ratio by which an excess molar ratio of the hydroxyl groups of the polyol component to the isocyanate groups of polyisocyanate is provided. In this reaction, a solvent, and a catalyst (dibutyltin dilaurylate or the like) which has been known in urethanating reactions may be used. The proportion of the urethane bonds may be adjusted by regulating the molecular weight of the polyol to be the raw material, and the compounding ratio of the polyol and the polyisocyanate.

The polyol component that constitutes the base material is preferably the aforementioned urethane polyol employed in practice. In other words, it is preferred that the polyol component that constitutes the base material be substantially the urethane polyol. However, a polyol which is compatible with the urethane polyol, and does not have an urethane bond may be also included. The polyol not including the urethane bonds is not particularly limited, but the polyol described above as the raw material for the synthesis of the urethane polyol can be used. When the polyol not including the urethane bonds is included in the base material, the content of the urethane polyol in the base material is preferably equal to or greater than 50% by weight, and more preferably equal to or greater than 80% by weight, in light of shortening of the drying time period.

The paint layer may also include additives which can be generally included in paints for golf balls, in addition to the resin component, and the ultraviolet ray absorbing agent described later. Exemplary additive may be an antioxidant, a light stabilizer, a fluorescent brightening agent, an antiblocking agent, a pigment, and the like.

For the mark layer which may be provided on the surface of the cover, any commonly used ink composition for marks of golf balls can be employed. This ink composition for marks may include a pigment, a solvent, a base polymer, and other additives, and the like. Examples of the base polymer for use in the ink composition for marks include polyester resins, epoxy resins, cellulose nitrate, acrylic resins, vinyl chloride-vinyl acetate copolymers, polyurethane resins, polyamide resins and the like. In light of excellent adhesiveness, epoxy resins, polyester resins, cellulose nitrate and the like are preferred. When the epoxy resin is used as the base polymer, for example, polyisocyanate such as hexamethylene diisocyanate, isophorone diisocyanate, and tolylene diisocyanate can be suitably used as a curing agent. The solvent of the ink composition for marks is not particularly limited, but cyclohexanone, acetyl acetone, propylene glycol monomethyl ether acetate, methoxymethylbutyl acetate, ethyl acetate, aromatic hydrocarbon or the like, or a mixed solvent of two or more kinds thereof may be exemplified. Examples of the other additive include a matting agent, a deforming agent and the like. The matting agent may be colloidal silica, low density polyethylene particles, intermediate density polyethylene particles, or the like. The deforming agent may be methylsiloxane, or the like.

The paint layer and the cover include an ultraviolet ray absorbing agent. The ultraviolet ray absorbing agent absorbs an ultraviolet ray per se. The ultraviolet ray absorbing agent included in the paint layer results in reduction of the ultraviolet ray that reaches to the cover. The ultraviolet ray absorbing agent included in the cover leads to decrease of influences of the ultraviolet ray on the thermoplastic polyurethane elastomer of the cover.

The ultraviolet ray absorbing agent included in the paint layer is not limited. Illustrative examples of the ultraviolet ray absorbing agent included in the paint layer include salicylic acid derivatives, benzophenone based agents, benzotriazole based agents, cyanoacrylate based agents, triazine based agents, nickel complexes, and the like. Examples of the salicylic acid derivative include phenyl salicylate, p-t-butylphenyl salicylate, p-octylphenyl salicylate and the like. Examples of the benzophenone based agent include 2,4-dihydroxybenzophenone, 2-hydroxy-4-methoxybenzophenone, 2-hydroxy-4-octoxybenzophenone, 2,2-dihydroxy-4,4'-methoxybenzophenone and the like. Examples of the benzotriazole based agent include 2-(2'-hydroxy-5'-methylphenyl)benzotriazole, 2-(2'-hydroxy-5'-t-butylphenyl)benzotriazole, 2-(2-hydroxy-3'-t-butyl-5'-methylphenyl)-5-chlorobenzotriazole, 2-[2-hydroxy-3,5-bis(α,α-dimethylbenzyl)phenyl]-2H-benzotriazole, 2-(5-methyl-2-hydroxyphenyl)benzotriazole and the like, but not limited thereto. Examples of the cyanoacrylate based agent include 2-ethylhexyl-2-cyano-3,3-diphenyl acrylate, ethyl-2-cyano-3,3'-diphenyl acrylate and the like, but not limited thereto. Examples of the triazine based agent include 2-(4,6-diphenyl-1,3,5-triazine-2-yl)-5[(hexyl)oxy]-phenol, but not limited thereto. Specifically, the benzophenone based agent may be Sumisoap 130, Sumisoap 140 or the like manufactured by Sumitomo Chemical Co., Ltd.; the benzotriazole based agent may be TINUVIN 234, TINUVIN 900, TINUVIN 326, TINUVIN P or the like manufactured by Ciba Specialty Chemicals plc.; and the cyanoacrylate based agent may be Uvinul N-35 or the like manufactured by BASF Corporation. The triazine based agent may be TINUVIN 1577 or the like manufactured by Ciba Specialty Chemicals plc.

The ultraviolet ray absorbing agent included in the cover 6 is not limited. Illustrative examples of the ultraviolet ray absorbing agent included in the cover 6 include salicylic acid derivatives, benzophenone based agents, benzotriazole based agents, cyanoacrylate based agents, triazine based agents, nickel complexes, and the like. Examples of the salicylic acid derivative include phenyl salicylate, p-t-butylphenyl salicylate, p-octylphenyl salicylate and the like. Examples of the benzophenone based agent include 2,4-dihydroxybenzophenone, 2-hydroxy-4-methoxybenzophenone, 2-hydroxy-4-octoxybenzophenone, 2,2-dihydroxy-4,4'-methoxybenzophenone and the like. Examples of the benzotriazole based agent include 2-(2'-hydroxy-5'-methylphenyl)benzotriazole, 2-(2'-hydroxy-5'-t-butylphenyl)benzotriazole, 2-(2-hydroxy-3'-t-butyl-5'-methylphenyl)-5-chlorobenzotriazole and the like, but not limited thereto. Examples of the cyanoacrylate based agent include 2-ethylhexyl-2-cyano-3,3-diphenyl acrylate, ethyl-2-cyano-3,3'-diphenyl acrylate and the like, but not limited thereto. Examples of the triazine based agent include 2-(4,6-diphenyl-1,3,5-triazine-2-yl)-5[(hexyl)oxy]-phenol, but not limited thereto. Specifically, the benzophenone based agent may be Sumisoap 130, Sumisoap 140 or the like manufactured by Sumitomo Chemical Co., Ltd.; the benzotriazole based agent may be TINUVIN 234, TINUVIN 900, TINUVIN 326, TINUVIN P or the like manufactured by Ciba Specialty Chemicals plc.; the cyanoacrylate based agent may be Uvinul N-35 or the like manufactured by BASF Corporation. The triazine based agent may be TINUVIN 1577 or the like manufactured by Ciba Specialty Chemicals plc.

In light of inhibition of the color change of the cover 6, the ultraviolet ray absorbing agent included in the cover 6 can preferably absorb an ultraviolet ray of 280 to 400 nm. The ultraviolet ray absorbing agent included in the cover 6 is preferably a benzophenone based agent, a benzotriazole based agent and a cyanoacrylate based agent, and particularly preferably a benzotriazole based agent.

In light of inhibition of the color change of the cover 6, the content of the ultraviolet ray absorbing agent in the cover 6 is preferably equal to or greater than 0.01 parts by weight, more preferably equal to or greater than 0.1 parts by weight, and still more preferably equal to or greater than 1 part by weight per 100 parts by weight of the base polymer. In light of improvement of the color tone in appearance, and reduction of the cost, the content of the ultraviolet ray absorbing agent in the cover 6 is preferably equal to or less than 10 parts by weight, and more preferably equal to or less than 5 parts by weight per 100 parts by weight of the base polymer.

In light of inhibition of the ultraviolet ray that reaches to the cover 6, the content of the ultraviolet ray absorbing agent in the paint layer 12 is preferably equal to or greater than 0.01 parts by weight, more preferably equal to or greater than 0.1 parts by weight, and still more preferably equal to or greater than 1 part by weight per 100 parts by weight of the resin component. In light of improvement of the color tone in appearance of the paint layer 12, and reduction of the cost, the content of the ultraviolet ray absorbing agent in the paint layer 12 is preferably equal to or less than 10 parts by weight, and more preferably equal to or less than 5 parts by weight per 100 parts by weight of the resin component.

According to the present invention, the same ultraviolet ray absorbing agent is included in the cover 6 and the paint layer 12. The ultraviolet ray absorbing agent included in both the cover 6 and the paint layer 12 is herein referred to as "common ultraviolet ray absorbing agent". The golf ball 2 of the present invention includes the common ultraviolet ray absorbing agent. The common ultraviolet ray absorbing agent may be either of one kind, or of two or more kinds.

The common ultraviolet ray absorbing agent is not limited. As the common ultraviolet ray absorbing agent, any one of the ultraviolet ray absorbing agents which can be included in the cover 6 or the paint layer 12 may be selected. In light of inhibition of the color change of the cover, it is preferred that this common ultraviolet ray absorbing agent preferably absorbs an ultraviolet ray of 280 to 400 nm, and the peak frequency that maximizes the absorbency (maximum absorption peak frequency) be 300 nm or greater and 380 nm or less. In light of inhibition of the color change of the cover 6, the common ultraviolet ray absorbing agent is preferably a salicylic acid derivative, a benzophenone based agent, a benzotriazole based agent, a cyanoacrylate based agent and a triazine based agent, and particularly preferably a benzotriazole based ultraviolet ray absorbing agent.

By blending the same ultraviolet ray absorbing agent in the paint layer 12 as that included in the cover 6, the ultraviolet ray that reaches to the cover 6 can be blocked or decreased. Accordingly, the burden to the cover 6 by the ultraviolet ray can be reduced. In addition, the common ultraviolet ray absorbing agent blended in the cover 6 absorbs the ultraviolet ray that passed through the paint layer 12. Thus, weathering color change can be inhibited as compared with the case in which the ultraviolet ray absorbing agent was blended only in the cover 6.

It was proven that the color change is not necessarily increasingly inhibited as the amount of the blended ultraviolet ray absorbing agent is increased. More specifically, it was proven that the effect of inhibiting the color change is not improved when the amount of the blended ultraviolet ray absorbing agent exceeds a certain amount, even though the amount of the ultraviolet ray absorbing agent is increased. According to the present invention, since the same ultraviolet ray absorbing agent is distributed in the cover 6 and the paint layer 12, the same ultraviolet ray absorbing agent acts in multiple steps. Thus, according to the present invention, the effect of inhibiting the color change is exhibited beyond the effect exhibited when only the cover 6 includes the ultraviolet ray absorbing agent, whereby a marked effect is exerted as compared with prior arts. This effect can be further improved by providing two or more paint layers 12.

When the cover 6 includes A parts by weight of the common ultraviolet ray absorbing agent per 100 parts by weight of the base polymer, and the paint layer 12 includes B parts by weight of the common ultraviolet ray absorbing agent per 100 parts by weight of the resin component, the ratio (A/B) is considered. When the ratio (A/B) is small, the color change is likely to be inhibited in initial stages of using the ball due to the ultraviolet ray absorbing agent present in the paint layer 12, but the ball becomes more likely to subject to color change when the period of use of the ball is prolonged. In light of inhibition of the color change in use for a long period of time, the ratio (A/B) is preferably equal to or greater than 0.1 (1/10), more preferably equal to or greater than 1/7, and still more preferably equal to or greater than 1/5. When the ratio (A/B) is too great, the ultraviolet ray that passes through the paint layer 12 and reaches to the cover 6 is likely to be increased, and the color change is likely to be caused in the initial stage of using the ball. In light of inhibition of the color change in the initial stage of using the ball, the ratio (A/B) is preferably equal to or less than 10, more preferably equal to or less than 7, and still more preferably equal to or less than 5.

Preferably, the paint layer 12 may include two or more kinds of ultraviolet ray absorbing agents. Owing to the two or more kinds of ultraviolet ray absorbing agents, the wavelength range of the ultraviolet ray which can be absorbed in the paint layer is broadened, whereby the color change of the cover 6 becomes more likely to be inhibited.

Preferably, the paint layer 12 may include C parts by weight of the ultraviolet ray absorbing agent other than the common ultraviolet ray absorbing agent per 100 parts by weight of the resin component. By including the ultraviolet ray absorbing agent other than the common ultraviolet ray absorbing agent, the wavelength range of the ultraviolet ray which can be absorbed is broadened, whereby the color change of the cover 6 becomes more likely to be inhibited. In light of broadening of the wavelength range of the ultraviolet ray which can be absorbed, the ratio (B/C) is preferably equal to or greater than 0.2, more preferably equal to or greater than 0.25, and still more preferably equal to or greater than 0.33 (1/3). In light of broadening of the wavelength range of the ultraviolet ray which can be absorbed, the ratio (B/C) is preferably equal to or less than 5, more preferably equal to or less than 4, and still more preferably equal to or less than 3.

In light of broadening of the wavelength range of the ultraviolet ray which can be absorbed, the ultraviolet ray absorbing agent other than the common ultraviolet ray absorbing agent preferably has a maximum absorption peak frequency which differs from that of the common ultraviolet ray absorbing agent. The maximum absorption peak frequency refers to a frequency that maximizes the absorbency. In light of broadening of the wavelength range of the ultraviolet ray which can be absorbed, the ultraviolet ray absorbing agent other than the common ultraviolet ray absorbing agent has a maximum absorption peak frequency of preferably equal to or greater than 250 nm and less than 300 nm.

The ultraviolet ray absorbing agent other than the common ultraviolet ray absorbing agent is not limited. As the ultraviolet ray absorbing agent other than the common ultraviolet ray absorbing agent, a salicylic acid derivative, a benzophenone based agent, a benzotriazole based agent, a cyanoacrylate based agent and a triazine based agent are preferred, and a triazine based agent is particularly preferred. The triazine based ultraviolet ray absorbing agent has a maximum absorption peak frequency which differs from that of the benzotriazole based ultraviolet ray absorbing agent. The triazine based ultraviolet ray absorbing agent can effectively absorb the ultraviolet ray having a frequency which is not absorbed by the benzotriazole based ultraviolet ray absorbing agent and the like.

It is preferred that the cover 6 or the paint layer 12 includes a light stabilizer. The light stabilizer can capture free radicals generated by the ultraviolet ray. This capture can inhibit the influence of the ultraviolet ray. The light stabilizer itself scarcely absorbs the ultraviolet ray. The mechanism for inhibiting the influence of the ultraviolet ray by the ultraviolet ray absorbing agent is different from that by the light stabilizer. Therefore, use in combination of the ultraviolet ray absorbing agent with the light stabilizer can synergistically inhibit the influence by the ultraviolet ray. The light stabilizer is preferably included in the paint layer 12.

In light of improvement of the synergistic effect with the ultraviolet ray absorbing agent, and inhibition of the color change of the cover 6, the light stabilizer is preferably a hindered amine based light stabilizer. Examples of the hindered amine based light stabilizer include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 4-benzoyloxy-2,2,6,6-tetramethylpiperidine, poly[{6-(1,1,3,3-tetramethylbutyl)amino-1,3,5-triazine-2,4-diyl}{(2,2,6,6-tetramethyl-4-piperidyl)imino}hexamethylene{(2,2,6,6-tetramethyl-4-piperidyl)}imino], and the like. In light of inhibition of the color change of the cover 6, bis(2,2,6,6-tetramethyl-4-piperidyl)sebacate is particularly preferred.

Specific examples of bis(2,2,6,6-tetramethyl-4-piperidyl)sebacate include trade names "Sanol LS-770" and "Sanol LS-770P" sold by SANKYO Lifetech Co., Ltd. Specific examples of bis(1,2,2,6,6-pentamethyl-4-piperidyl)sebacate include trade names "Sanol LS-765" and "Sanol LS-292" sold by SANKYO Lifetech Co., Ltd. Examples of 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine include trade name "Sanol LS-2626" sold by SANKYO Lifetech Co., Ltd. Examples of 4-benzoyloxy-2,2,6,6-tetramethylpiperidine include trade name "Sanol LS-744" sold by SANKYO Lifetech Co., Ltd. Examples of poly[{6-(1,1,3,3-tetramethylbutyl)amino-1,3,5-triazine-2,4-diyl}{(2,2,6,6-tetramethyl-4-piperidyl)imino}hexamethylene{(2,2,6,6-tetramethyl-4-piperidyl)}imino] include trade name "Sanol LS-944" sold by SANKYO Lifetech Co., Ltd.

According to the golf ball of the present invention, owing to the synergistic effect exhibited by the ultraviolet ray absorbing agent included in the cover and the ultraviolet ray absorbing agent included in the paint layer, color change of the urethane resin that constitutes the cover can be effectively inhibited.

EXAMPLES

Hereinafter, advantages of the present invention will be explained by way of Examples, however, the present invention should not be construed as being limited based on the description of the Examples.

Example 1

A rubber composition was obtained by kneading 100 parts by weight of polybutadiene synthesized using a rare-earth element based catalyst (trade name "BR-730", available from JSR Corporation), 32 parts by weight of zinc diacrylate, 5 parts of zinc oxide, an adequate amount of barium sulfate, 0.5 parts by weight of diphenyl disulfide and 0.7 parts by weight of dicumyl peroxide (NOF Corporation). This rubber composition was placed into a mold having upper and lower mold half each having a hemispherical cavity, and heated at 170° C. for 30 minutes to obtain a core. The compounded composition of the core is shown in Table 1 below. The core had a diameter of 39.6 mm. The amount of compressive deformation Ch of the core was 3.4 mm. On the other hand, 100 parts by weight of a thermoplastic polyurethane elastomer ("Elastolan 1195ATR" supra), 2 parts by weight of a benzotriazole based ultraviolet ray absorbing agent ("TINUVIN P" supra), 0.5 parts by weight of a hindered amine based light stabilizer ("Sanol LS-770P" supra) and 3 parts by weight of titanium oxide were kneaded to obtain a resin composition. The core was placed into a final mold having numerous pimples on the inside face, followed by injection of the aforementioned resin composition around the core by injection molding to form a cover. The cover had a thickness of 1.6 mm. Numerous dimples having a shape inverted from the shape of the pimple were formed on the cover. PTMG250 (polyoxytetramethylene glycol available from BASF Corporation, molecular weight: 250) in an amount of 60 parts by weight and 54 parts by weight of 550U (branched polyol available from Sumika Bayer Urethane Co., Ltd., molecular weight: 250) were dissolved in 120 parts by weight of a solvent (toluene and methyl ethyl ketone). To this solution was added 0.1% by weight of dibutyltin dilaurylate. While keeping this solution at 80° C., thereto was added 66 parts by weight of isophorone diisocyanate dropwise to obtain a base material. This base material had a solid content of 60% by weight, and a hydroxyl value of 75 mg KOH/g, and had a weight average molecular weight of 7,808. This base material and a curing agent (isophorone diisocyanate, Sumika Bayer Urethane Co., Ltd) were mixed to give NCO/OH of 1.2 (molar ratio). Moreover, 1 part by weight of a benzotriazole based ultraviolet ray absorbing agent ("TINUVIN P", supra) and 0.3 parts by weight of a fluorescent brightening agent (Ciba Specialty Chemicals plc., "UBITEX OB") per 100 parts by weight of the resin component were added to obtain a composition for paints. This composition was coated around the cover to form a clear paint layer, whereby a golf ball of Example 1 was obtained. This golf ball had a diameter of 42.8 mm, and a weight of 45.4 g.

Examples 2 to 4

Golf balls of Examples 2 to 4 were obtained in a similar manner to Example 1 except that the compositions of the cover and the paint layer were as shown in Table 2 below. Details of the compositions of the cover and the paint layer are presented in Table 2 below.

Example 5 and Comparative Examples 1 to 5

Golf balls of Example 5 and Comparative Examples 1 to 5 were obtained in a similar manner to Example 1 except that two paint layers were provided, and the compositions of the cover and the paint layer were as shown in Table 2 below. Details of the compositions of the cover and the paint layer are presented in Table 2 below.

In Comparative Example 5, ionomer was used as the base polymer of the cover. Trade names "Himilan 1555", "Himilan 1557" and "Himilan 1855" available from Du Pont-MITSUI POLYCHEMICALS Co., Ltd. were used as the ionomer.

In all Examples and Comparative Examples, the weight of the ball was adjusted to 45.4 g by altering the specific gravity of the core. The specific gravity of the core was regulated by the amount of blended barium sulfate.

"TINUVIN 234" is 2-[2-hydroxy-3,5-bis(α,α-dimethylbenzyl)phenyl]-2H-benzotriazole, "TINUVIN P" is 2-(5-methyl-2-hydroxyphenyl)benzotriazole, and "TINUVIN 1577" is 2-(4,6-diphenyl-1,3,5-triazine-2-yl)-5[(hexyl)oxy]-phenol.

Measurement of Cover Hardness (Shore-D)

A sheet consisting of the resin composition of the cover was produced, and subjected to the measurement. The measurement was carried out in accordance with a standard of "ASTM-D 2240-68" by the method as described above.

Scuff Resistance Performance

An iron club (trade name "XXIO" available from SRI Sports Limited, shaft: S, category: sand wedge) was attached to a swing machine available from Golf Laboratories, Co., Ltd. The golf ball was hit under the condition to provide a head speed of 36 m/sec, and the extent of scuff was visually inspected. Evaluation results integrated from the tests conducted 20 times are presented in Table 2 below. The extent of the scuff was evaluated according to the following standards on the grade of four:

"A": favorable;

"B": somewhat favorable;

"C": somewhat inferior; and

"D": inferior.

Weathering Color Change Likelihood

Weather resistance test was carried out with Sunshine Super Long-life Weather Meter (type WEL-SUN-HC/B) manufactured by Suga Test Instrument Co., Ltd. The test conditions complied with JIS D0205, involving: temperature in the bath of 63° C.; humidity of 50%; and rainfall condition of "raining for 12 min in a period of 60 min". Indices L*, a* and b* were measured at the same measurement point prior to the weather resistance test, following the weather resistance test for 24 hrs and following the weather resistance test for 120 hrs. The difference of each of the indices ΔL, Δa and Δb before and after exposing to the weathering condition was calculated. Thereafter, ΔE was calculated by the following formula. The ΔE derived from the weather resistance test for 24 hrs, and the ΔE derived from the weather resistance test for 120 hrs are presented in Table 2 below.

$$\Delta E=[(\Delta L)^2+(\Delta a)^2+(\Delta b)^2]^{1/2}$$

For the measurement of the indices L*, a* and b*, Spectrophotometer "CM-3500d" available from Konica Minolta Co., Ltd. was used. The light receiver was applied on the surface of the golf ball (surface of the paint layer), whereby the measurement was carried out. A "standard light $D_{65}$" was employed as a light source. The color temperature of this light source was 6504 k. The spectral sensitivity employed was "2° field of view".

The indices L*, a* and b* are indices L *, a *, and b * in the CIELAB color coordinate system. The indices L*, a* and b* are calculated according to the following formulae:

$$L^*=116(Y/Yn)^{1/3}-16;$$

$$a^*=500((X/Xn)^{1/3}-(Y/Yn)^{1/3}); \text{ and}$$

$$b^*=200((Y/Yn)^{1/3}-(Z/Zn)^{1/3}).$$

In these formulae, X, Y and Z represent three psychophysical color specifications in the XYZ color coordinate system, while Xn, Yn and Zn represent three psychophysical color specifications on a perfect reflecting diffuser. The CIELAB color coordinate system conforms to a standard determined by Commission Internationale de l'Echairage (CIE) in 1976. In Japan, the CIELAB color coordinate system is employed in "JIS Z 8729". L* is an index of brightness. The a* and b* are indices that correlate with color and chroma saturation. The increasing negative values of a* indicate green direction, while the increasing positive values thereof indicate red direction. The increasing negative values of b* indicate blue direction, while the increasing positive values thereof indicate yellow direction.

TABLE 1

Compounded Composition of Core in Examples and Comparative Examples

| | |
|---|---|
| BR-730 | 100 |
| Zinc diacrylate | 32 |
| Zinc oxide | 5 |
| Barium sulfate | adequate amount |
| DPDS | 0.5 |
| DCP | 0.7 |

TABLE 2

Specifications and Evaluation Results of Examples and Comparative Examples

| | | Example 1 | Example 2 | Example 3 | Example 4 | Example 5 | Comparative Example 1 | Comparative Example 2 | Comparative Example 3 | Comparative Example 4 | Comparative Example 5 |
|---|---|---|---|---|---|---|---|---|---|---|---|
| Compounded composition of cover (parts by weight) | Elastolan 1195ATR | 100 | 100 | 100 | 100 | 100 | 100 | 100 | 100 | 100 | — |
| | Himilan 1555 | — | — | — | — | — | — | — | — | — | 10 |
| | Himilan 1557 | — | — | — | — | — | — | — | — | — | 10 |
| | Himilan 1855 | — | — | — | — | — | — | — | — | — | 80 |
| | TINUVIN 234 | — | — | 3 | — | — | — | — | — | 0.5 | — |
| | TINUVIN P | 2 | 2 | — | 4 | 2 | 2 | — | 2 | — | 2 |
| | Sanol LS770P | 0.5 | 0.5 | 0.5 | 0.5 | 0.5 | 0.5 | 0.5 | 0.5 | 0.5 | 0.5 |
| | Titanium oxide | 3 | 3 | 3 | 3 | 3 | 3 | 3 | 3 | 3 | 3 |
| Parts by weight A | | 2 | 2 | 3 | 4 | 2 | — | — | — | 0.5 | 0.5 |
| Cover hardness (Shore-D) | | 47 | 47 | 47 | 47 | 47 | 47 | 47 | 47 | 47 | 50 |
| Compounded composition of paint layer (inner paint layer) (parts by weight) | two-component cured polyurethane resin | 100 | 100 | 100 | 100 | 100 | 100 | 100 | 100 | 100 | 100 |
| | TINUVIN 234 | — | — | 2 | — | — | 1 | — | — | 10 | — |
| | TINUVIN P | 1 | 1 | — | 0.5 | 2 | — | 3 | — | 0.1 | 1 |
| | TINUVIN 1577 | — | 2 | 2 | 1 | — | — | — | — | — | — |
| | UBITEX OB | 0.3 | 0.3 | 0.3 | 0.3 | 0.3 | 0.3 | 0.3 | 0.3 | 0.3 | 0.3 |

TABLE 2-continued

Specifications and Evaluation Results of Examples and Comparative Examples

| | | Example 1 | Example 2 | Example 3 | Example 4 | Example 5 | Comparative Example 1 | Comparative Example 2 | Comparative Example 3 | Comparative Example 4 | Comparative Example 5 |
|---|---|---|---|---|---|---|---|---|---|---|---|
| Compounded composition of external paint layer (parts by weight) | Compounded composition of external paint layer (parts by weight) | — | — | — | — | 100 | 100 | 100 | 100 | 100 | 100 |
| | TINUVIN 234 | — | — | — | — | — | 1 | — | — | 10 | — |
| | TINUVIN P | — | — | — | — | 2 | — | 3 | — | 0.1 | 1 |
| | UBITEX OB | — | — | — | — | 0.3 | 0.3 | 0.3 | 0.3 | 0.3 | 0.3 |
| Parts by weight B | | 1 | 1 | 2 | 0.5 | 2 | — | — | — | 20 | 1 |
| Parts by weight C | | — | 2 | 2 | 1 | — | 2 | 6 | — | 0.2 | — |
| Ratio A/B | | 2 | 2 | 1.5 | 8 | 0.5 | — | — | — | 0.025 | 1 |
| Ratio B/C | | — | 0.5 | 1 | 0.5 | — | — | — | — | 100 | — |
| 24 hrs. Weathering color change (ΔE) | | 3 | 2 | 4 | 3.5 | 2 | 6 | 4 | 9 | 3 | 4 |
| 120 hrs. Weathering color change (ΔE) | | 8 | 7 | 8 | 7 | 7 | 11 | 13 | 14 | 12 | 5 |
| Scuff resistance | | A | A | A | A | A | A | A | A | A | C |

As shown in Table 2, the golf balls of Examples are excellent in the weathering color change likelihood and scuff resistance performance. Therefore, advantages of the present invention are clearly suggested by these results of evaluation.

The golf ball according to the present invention is suited for the play at golf course, and practice in the driving range.

The foregoing description is just for illustrative examples, therefore, various modifications can be made in the scope without departing from the principles of the present invention.

What is claimed is:

1. A golf ball which comprises a core, a cover and a paint layer, the base polymer of the cover comprising a thermoplastic polyurethane elastomer, the cover comprising one or more kinds of ultraviolet ray absorbing agents, the paint layer comprising one or more kinds of ultraviolet ray absorbing agents, one or more kinds of common ultraviolet ray absorbing agents being present which are the ultraviolet ray absorbing agent included in both the cover and the paint layer, the cover comprising the common ultraviolet ray absorbing agent in an amount of A parts by weight per 100 parts by weight of the base polymer, and the paint layer comprising the common ultraviolet ray absorbing agent in an amount of B parts by weight per 100 parts by weight of the resin component, with the ratio (A/B) being 0.1 or greater and 10 or less.

2. The golf ball according to claim 1, wherein the thermoplastic polyurethane elastomer is an MDI based polyurethane elastomer.

3. The golf ball according to claim 1, wherein the proportion of the ultraviolet ray absorbing agent included in the cover is 0.01 parts by weight or greater and 10 parts by weight or less per 100 parts by weight of the base polymer, and the proportion of the ultraviolet ray absorbing agent included in the paint layer is 0.01 parts by weight or greater and 10 parts by weight or less per 100 parts by weight of the resin component.

4. The golf ball according to claim 1, wherein the paint layer comprises two or more kinds of ultraviolet ray absorbing agents.

5. The golf ball according to claim 1, wherein the paint layer comprises an ultraviolet ray absorbing agent other than the common ultraviolet ray absorbing agent in an amount of C parts by weight per 100 parts by weight of the resin component, with the ratio (B/C) being 0.2 or greater and 5 or less.

6. The golf ball according to claim 1, wherein the common ultraviolet ray absorbing agent is a benzotriazole based ultraviolet ray absorbing agent.

7. The golf ball according to claim 1, wherein the paint layer comprises a triazine based ultraviolet ray absorbing agent as the ultraviolet ray absorbing agent other than the common ultraviolet ray absorbing agent.

8. A golf ball which comprises a core, a cover and a paint layer, the base polymer of the cover comprising a thermoplastic polyurethane elastomer, the cover comprising one or more ultraviolet ray absorbing agents, the paint layer comprising one or more ultraviolet ray absorbing agents, wherein the cover and paint layer each include at least one common ultraviolet ray absorbing agent, the cover comprises the common ultraviolet ray absorbing agent in an amount of A parts by weight per 100 parts by weight of the base polymer, and the paint layer comprising the common ultraviolet ray absorbing agent in an amount of B parts by weight per 100 parts by weight of the resin component, with the ratio (A/B) being 0.1 or greater and 10 or less, and the ultraviolet ray absorbing agents are selected from the group consisting of salicylic acid derivatives, benzophenone based agents, benzotriazole based agents, cyanoacrylate based agents, triazine based agents, and nickel complexes.

9. The golf ball according to claim 8, wherein the thermoplastic polyurethane elastomer is an MDI based polyurethane elastomer.

10. The golf ball according to claim 9, wherein the proportion of the ultraviolet ray absorbing agent included in the cover is 0.01 parts by weight or greater and 10 parts by weight or less per 100 parts by weight of the base polymer, and the proportion of the ultraviolet ray absorbing agent included in the paint layer is 0.01 parts by weight or greater and 10 parts by weight or less per 100 parts by weight of the resin component.

11. The golf ball according to claim 10, wherein the paint layer comprises two or more ultraviolet ray absorbing agents.

12. The golf ball according to claim 11, wherein the paint layer comprises an ultraviolet ray absorbing agent other than the common ultraviolet ray absorbing agent in an amount of C parts by weight per 100 parts by weight of the resin component, with the ratio (B/C) being 0.2 or greater and 5 or less.

13. The golf ball according to claim 12, wherein the common ultraviolet ray absorbing agent is a benzotriazole based ultraviolet ray absorbing agent.

14. The golf ball according to claim 13, wherein the paint layer comprises a triazine based ultraviolet ray absorbing agent as the ultraviolet ray absorbing agent other than the common ultraviolet ray absorbing agent.

* * * * *